US006205292B1

(12) United States Patent
Pokorny et al.

(10) Patent No.: US 6,205,292 B1
(45) Date of Patent: Mar. 20, 2001

(54) FLUID HEATER

(75) Inventors: Joachim Pokorny, Hüfingen; Andreas Steinrücke, Talheim, both of (DE)

(73) Assignee: STEAG MicroTech GmbH (DE)

( * ) Notice: Subject to any disclaimer, the term of this patent is extended or adjusted under 35 U.S.C. 154(b) by 0 days.

(21) Appl. No.: 09/155,752

(22) PCT Filed: Jan. 4, 1997

(86) PCT No.: PCT/EP97/00028

§ 371 Date: Oct. 2, 1998

§ 102(e) Date: Oct. 2, 1998

(87) PCT Pub. No.: WO97/38554

PCT Pub. Date: Oct. 16, 1997

(30) Foreign Application Priority Data

Apr. 3, 1996 (DE) ..... 196 13 411

(51) Int. Cl.[7] ..... F24H 1/10; H05B 1/02

(52) U.S. Cl. ..... 392/489; 392/465; 392/498

(58) Field of Search ..... 392/465, 478, 392/480, 488, 489

(56) References Cited

U.S. PATENT DOCUMENTS

| | | | |
|---|---|---|---|
| 3,906,188 | 9/1975 | Gamell . | |
| 5,054,107 | 10/1991 | Batchelder . | |
| 5,054,108 | 10/1991 | Gustin et al. . | |
| 5,271,086 * | 12/1993 | Kamiyama et al. | 392/483 |
| 5,371,830 | 12/1994 | Wachenheim . | |
| 5,408,578 * | 4/1995 | Bolivar | 392/490 |
| 5,740,315 * | 4/1998 | Onishi et al. | 392/489 |
| 5,872,890 * | 2/1999 | LaCombe | 392/487 |

FOREIGN PATENT DOCUMENTS

| | | |
|---|---|---|
| 1269748 | 8/1959 | (DE) . |
| 8913683 | 2/1990 | (DE) . |
| 3841448 | 5/1990 | (DE) . |
| 4420493 | 12/1995 | (DE) . |
| 0570586 | 11/1993 | (EP) . |
| 61116246 | 11/1984 | (JP) . |
| 01200143 | 2/1988 | (JP) . |

OTHER PUBLICATIONS

"Infrarot–Strahlen–Heizung"; 1964; pp. 2–8; Herbert Keller.

* cited by examiner

*Primary Examiner*—Teresa Walberg
*Assistant Examiner*—Thor Campbell
(74) *Attorney, Agent, or Firm*—Robert W. Becker & Associates

(57) ABSTRACT

A fluid heater has a fluid pipe through which a fluid flows. A radiant heating element is enclosed in a quartz mantle. The fluid pipe is concentrically arranged about the quartz mantle. A first temperature sensor is positioned at a section of the outer circumference of the fluid pipe opposite the heating element.

14 Claims, 1 Drawing Sheet

FLUID HEATER

BACKGROUND OF THE INVENTION

The present invention relates to a fluid heater including a pipe through which a fluid flows.

It is known to heat liquid and gasses in order to vaporize them or to pressurize them. The known devices, however, have a slow response time. It takes a relatively long time to heat the fluid to be heated after switching on the heater, and after switching off the heater heating of the fluid is not immediately ended.

From German Patent Application 44 20 493 a fluid heater of the aforementioned kind is known in which the heating elements are electric resistance bands applied to the outer circumference of the fluid pipe. Due to the indirect heating of the fluid through the pipe wall, a fast switching on and off of the heater without delay of the heating action and of the shutdown of the heating action for the fluid is not possible.

From the documents German Gebrauchsmuster 19 06 191, German Gebrauchsmuster 89 13 683, German Patent 38 41 448 and German published document 12 69 748, heating elements and radiant heaters are known which, however, are not designed for heating a fluid flowing through a pipe and are also not suitable for this purpose.

The object of the present invention is to provide a fluid heater which can be manufactured inexpensively and which provides for a fast switching on and switching off of the heater.

SUMMARY OF THE INVENTION

The inventive object is solved by a fluid heater such that the pipe is arranged concentrically about a radiant heater enclosed by a quartz mantle.

A special advantage of the present invention is that the quartz mantle only retains minimal heat so that directly after switching off the fluid heater the fluid is no longer being heated.

According to a preferred embodiment of the invention, the quartz mantle is a quartz tube that contains the radiant heater in the form of an electrical heating element. Preferably, at least a section of the quartz tube contains a heating wire. When a plurality of sections of the quartz tube contain a heating element, switching together of multiple heating elements provides an increased heating output.

According to a further preferred embodiment of the invention, a safety temperature sensor is provided at a section of the outer circumference of the fluid pipe positioned opposite of the section of the quartz tube. Preferably, the heating current flowing through the heating wire is switched off when the safety temperature sensor measures a temperature surpassing a predetermined temperature value. The temperature value provided by the safety temperature sensor furthermore shows whether gas flows through the fluid pipe because in this case the heating energy is transported by the fluid medium to the section of the outer circumference of the fluid pipe According to a further preferred embodiment of the invention, a second temperature sensor is provided at the outlet of the fluid pipe. Advantageously, the temperature value determined by the second temperature sensor is used for controlling the heating output.

Advantageously, the radiant heater is an infrared heater and the fluid pipe consists of stainless steel, a ceramic pipe, or a steel pipe that is lined with a ceramic material or a ceramic tube. With this embodiment, a large portion of the emitted heat energy coming from the radiant heater is reflected at the inner circumference of the fluid pipe into the fluid pipe.

BRIEF DESCRIPTION OF THE DRAWINGS

The invention as well as further advantages and embodiments thereof will be explained in the following with the description of particular embodiments with the aid of the drawings. It is shown in.

In the drawings, the same reference numerals indicate identical or corresponding elements.

DESCRIPTIONS OF THE PREFERRED EMBODIMENTS

Figure 1:
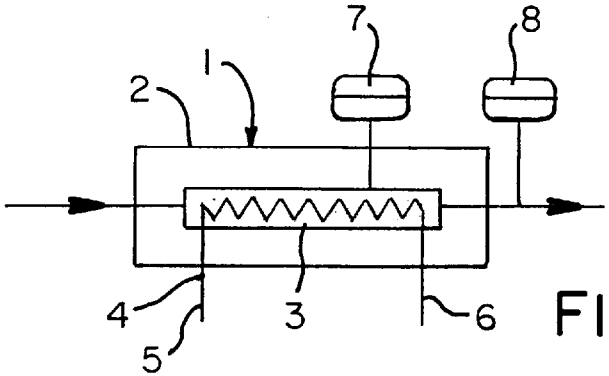
FIG. 1 a schematic representation of a first embodiment of the inventive fluid heater.

In FIG. 1 a first embodiment of the inventive fluid heater is schematically represented. The fluid heater 1 has a fluid pipe 2 in which a non-represented gas flows, whereby the flow direction is indicated by arrows in FIG. 1. In the fluid pipe 2 a quartz tube 3 is concentrically arranged that includes a heating wire 4. The heating wire 4 has two supply wires 5, 6 which are guided through openings in the quartz pipe 3 and the fluid pipe 2 to the exterior. By suppling a voltage to the supply wires 5, 6, the heating wire 4 is supplied with energy and radiates especially infrared heat that heats in a continuous flow method the gas flowing in the direction of the arrows.

A safety temperature sensor 7 senses the temperature at the outer side of the quartz mantle 3 in order to switch off the current to the heater when the temperature limit is surpassed. A second temperature sensor 8 senses the temperature of the gas downstream of the fluid heater 1 in an analog manner. The value of the temperature measured by the second temperature sensor 8 can be used for controlling the electrical output supplied to the heating wire 4 via the supply wires 5, 6 in order to maintain the temperature of the gas constant.

Figure 2:
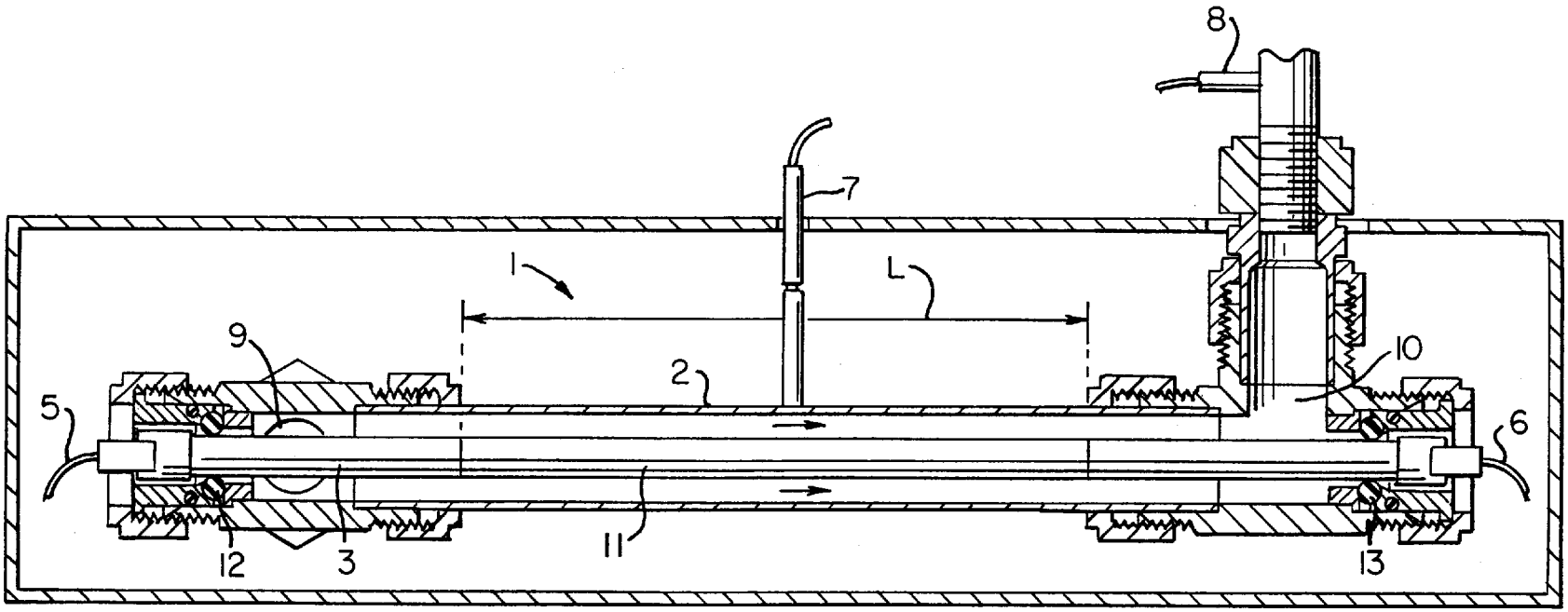
FIG. 2 a cross-sectional view of a second embodiment of the inventive fluid heater.

In FIG. 2 a cross-sectional view of a second embodiment of the present invention is represented. The fluid heater 1 has a fluid pipe 2 of polished stainless steel in which a non-represented gas, for example, nitrogen gas, flows. The flow direction is indicated by arrows. The gas enters through an inlet 9 arranged transverse to the fluid pipe 2 into the pipe 2 and exits through outlet 10 extending transverse to the fluid pipe 2 and rotated by 90° relative to the inlet 9. In the fluid pipe 2 a quartz mantle is axially symmetrically arranged which is embodied as a quartz tube 3 extending past the inlet 9 and the outlet 10. In the quartz tube 3 a non-represented heating wire is arranged extending along the schematically indicated length L within a section 11 of the quartz mantle 3. Supply wires 5, 6 are provided via which electrical voltage is supplied in order to heat the heating wire. In contrast to the embodiment represented in FIG. 1, the supply wires 5, 6 are guided within the quartz tube 3 and are guided through the ends of the quartz pipe out of the fluid pipe 2. The locations at which the quartz tube 3 exits from the fluid pipe 2 are provided with sealing devices 12, 13 at the inlet side 9, respectively, the outlet side 10 which are preferably embodied as sealing rings or gaskets. The safety temperature sensor 7 senses the temperature at the outer circumference of the fluid pipe 2. A second temperature sensor 8 senses, downstream of the heated section 11 of the quartz pipe 3 at the outer circumference of the tube guiding the fluid, the gas temperature.

The invention has been described with the aid of two preferred embodiments. However, to a person skilled in the art numerous variations and developments are obvious without deviating from the gist of the invention. For example, instead of a gas a liquid can be heated by the inventive heater.

The present invention is, of course, in no way restricted to the specific disclosure of the specification and drawings, but also encompasses any modifications within the scope of the appended claims.

What is claimed is:

1. A fluid heater (1) comprising:

a fluid pipe (2) through which a fluid flows;

a radiant heating element (4);

a quartz mantle (3) enclosing said radiant heating element (4);

said fluid pipe (2) concentrically arranged about said quartz mantle (3);

a first temperature sensor (7) positioned at a section of an outer circumference of said fluid pipe (2) opposite said heating element (4); and a second temperature sensor (8) positioned at an outlet (10) of said fluid pipe (2), wherein a temperature determined by said second temperature sensor (8) is used for controlling heating output of said heater.

2. A heater according to claim 1, wherein a heating current flowing through said heating element (4) is switched off when a temperature measured by temperature sensor (7) surpasses a predetermined temperature value.

3. A heater according to claim 1, wherein said heating element (4) is an infrared radiant heater.

4. A heater according to claim 1, wherein said heating element (4) is an electrical heating element.

5. A heater according to claim 1, wherein said heating element (4) is a heating wire.

6. A heater according to claim 1, wherein said quartz mantle is a quartz tube (3) that contains said heating element (4).

7. A heater according to claim 6, wherein said heating element (4) has supply wires (5, 6) guided to the exterior of said heater through at least one end of said quartz tube (3).

8. A heater according to claim 6, wherein said heating element (4) has supply wires (5, 6) guided to the exterior of said heater through at least one opening in the wall of said quartz tube (3).

9. A heater according to claim 6, wherein said heating element (4) is a heating wire contained in at least one section (11) of said quartz tube (3).

10. A heater according to claim 1, wherein a plurality of said heating elements (4) are provided.

11. A heater according to claim 1, wherein said fluid pipe (2) consists of stainless steel.

12. A heater according to claim 1, wherein said fluid pipe (2) consists of ceramic.

13. A heater according to claim 1, wherein said fluid pipe (2) is a steel pipe lined with ceramic.

14. A heater according to claim 1, wherein the fluid is a gas, preferably nitrogen.

* * * * *